US006354103B2

(12) United States Patent
Evans, Sr.

(10) Patent No.: US 6,354,103 B2
(45) Date of Patent: Mar. 12, 2002

(54) VERTICAL HEAT EXCHANGE UNIT

(76) Inventor: Fred Evans, Sr., P.O. Box 458, Stevensville, MD (US) 21686

( * ) Notice: Subject to any disclaimer, the term of this patent is extended or adjusted under 35 U.S.C. 154(b) by 0 days.

(21) Appl. No.: 09/873,549

(22) Filed: Jun. 4, 2001

Related U.S. Application Data

(63) Continuation-in-part of application No. 09/612,670, filed on Jul. 10, 2000, now abandoned, which is a continuation of application No. 09/372,830, filed on Aug. 12, 1999, now Pat. No. 6,085,536.

(51) Int. Cl.[7] ..... F25D 19/00
(52) U.S. Cl. ..... 62/454; 62/452
(58) Field of Search ..... 62/452, 454, 455, 62/456; 165/154, 141, 47, 158, 159, 160

(56) References Cited

U.S. PATENT DOCUMENTS 2,668,692 A * 2/1954 Hammell
5,379,832 A * 1/1995 Dempsey ..... 165/160 X

* cited by examiner

*Primary Examiner*—Henry Bennett
*Assistant Examiner*—Chen Wen Jiang
(74) *Attorney, Agent, or Firm*—Lieberman & Brandsdorfer, LLC

(57) ABSTRACT

The apparatus is a heat exchange unit for cooling interior rooms of commercial and/or residential structures. The unit includes a compressor and blower mounted within a base. A lid of the base has an elongated heat exchange tube mounted thereon. The heat exchange tube has an interior liner with a coil structure mounted to the outside surface thereof. An outer liner enclosed the interior liner and associated coil structure. Both the interior and exterior liners are composed of a perforated metallic material. The vertical heat exchange tube is enclosed with a baffle at the top portion thereof. The baffle functions to force air moving upward to travel in an outward and downward direction toward the base and outside of the liners through the perforations. In an alternative embodiment, the vertical heat exchange tube may include a intermediate tube mounted between the interior and exterior tubes. The intermediate tube also has coils wrapped about the perimeters. In general, the unit with two liners is designed to be a lower capacity unit than the unit with three liners. Accordingly, the unit may be expanded for greater efficiency designs by increasing the surface area of the coil structure, and by serially connecting multiple units.

20 Claims, 4 Drawing Sheets

VERTICAL HEAT EXCHANGE UNIT

CROSS REFERENCE TO RELATED APPLICATION(S)

This a Continuation-in-Part utility patent application of application Ser. No. 09/612,670, filed Jul. 10, 2000, entitled "Environmentally Adaptive HVAC Exterior Heat Exchange Unit", now abandoned, which is a Continuation patent application of application Ser. No. 09,372,830 filed Aug. 12, 1999 entitled "Enviromentally Adaptive HVAC Exterior Heat Exchange Unit", now U.S. Pat. No. 6,085,536.

BACKGROUND OF THE INVENTION

1. Technical Field

This invention relates to heat exchanger and air conditioner condenser units. More specifically, the present invention relates to an environmentally adaptive construction for the external unit of a HVAC unit.

2. Description of the Prior Art

Conventional heat exchange units are generally round or square in shape. They are configured with a set of heat exchanger coils surrounding the compressor and blower units. As such, the configuration of the coils define the shape of the unit as a whole. Most coil structures include fins for providing increased heat dissipation surface to the coil structure. The increased surface area enhances the cooling effect of the coil structure and allows the heat exchange unit to achieve the desired efficiency and output. The fins are generally soldered onto the coil structure to become permanently affixed thereto. The process of soldering fins to the coil structure is cumbersome and expensive. Accordingly, it is desirable to design a novel coil structure for a heat exchange unit that eliminates the need for soldering fins to the coil structure.

In addition to the design of the coil structure for efficiency and output purposes, it is also desirous to design a heat exchange unit that will not be an intrusive structure to the facility it is cooling. For example, most commercial and residential heat exchange units are situated in a rectangular or circular shaped container, which are placed adjacent to the structure they are cooling. A larger building will require a larger compressor unit and/or multiple units to sufficiently cool the interior spaces of the facility. It is often difficult to place external units in a location in relation to a building where the presence of the unit will not be intrusive. This can present obstacles to the full and effective use of the exterior spaces of a structure. In addition, large units are not only visually intrusive but can also create significant unwanted noise levels. Accordingly, it is therefore desirable to overcome the limitations of the prior art and to provide a unit which is efficient and has a camouflage appearance so as not to be directly noticeable to passers by.

SUMMARY OF THE INVENTION

It is an object of the present invention to provide an environmentally adaptive external unit for an HVAC system which will blend visually with the surroundings while providing efficient and effective heat exchange.

It is a further object of the present invention to provide an external HVAC unit which can be used to architecturally enhance the exterior of a structure. The unit includes a compressor to compress a refrigerant, a blower for circulating air over a coil structure and for circulating air through the housing, and a tube for delivering the compressed refrigerant to a heat exchanger tube. The heat exchanger tube is longitudinal and is mounted vertically to an exterior surface of the base of the housing. The heat exchanger tube includes a plurality of liners extending vertically from the base. The coiled structure is wrapped spirally about an exterior surface of an interior liner to provide a cooling surface.

It is yet a further object of the present invention to provide a method of cooling an enclosed structure. A housing is provided for storing a compressor and a blower. A vertical heat exchange tube structure is mounted on a top exterior surface of the housing. The tube includes an interior liner with a coil structure wrapped spirally about its exterior surface. A compressed refrigerant is delivered from the compressor to the heat exchange tube to dissipate heat.

Other features and advantages of this invention will become apparent from the following detailed description of the presently preferred embodiment of the invention, taken in conjunction with the accompanying drawings.

DESCRIPTION OF THE PREFERRED EMBODIMENT

Overview

Most heat exchange units for either residential or commercial structures are stored within box type structures and are noticeable to passers by. In general, all components of the apparatus are stored within the box and operate therefrom. The purpose of the vertical heat exchange tube for the heat exchange unit of the invention is to both improve operating efficiency and to provide an aesthetically pleasing structure that may not be noticeable to most passers by.

Technical Background

Figure 1:
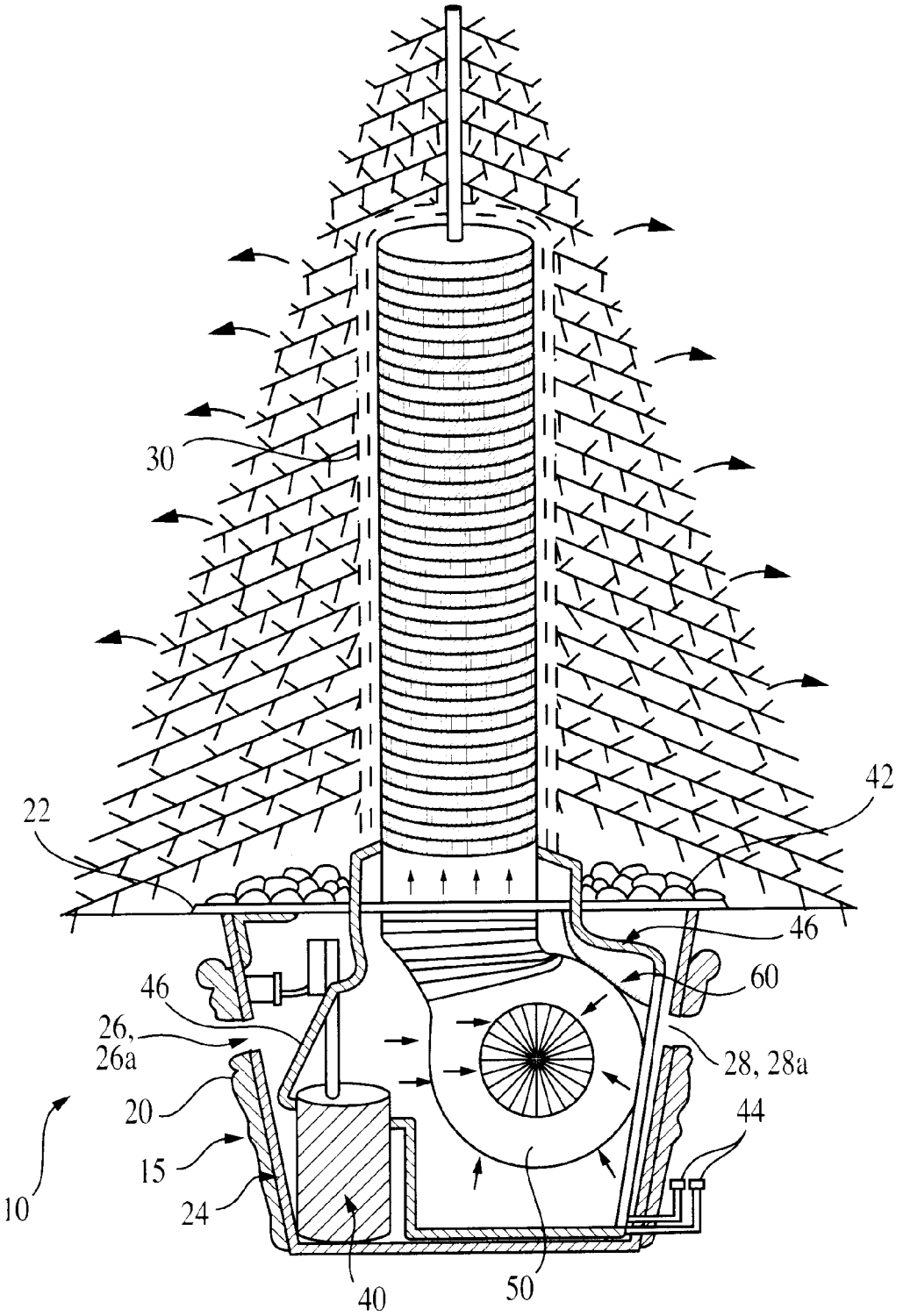
FIG. 1 is a sectional view of an elongated heat exchange unit according to the preferred embodiment of this invention, and is suggested for printing on the first page of the issued patent.

FIG. 1 is a sectional view of the heat exchange unit 10 showing the base 20 and the heat exchange tube 30. The base 20 acts as a storage compartment for the components of the unit 10 with the exception of the heat exchange tube. The base 20 can be made of any suitable material that can store and protect the components therein from the environment, and prevent the base from developing rust. The inside walls and bottom surface of the base 20 may be lined with an insulating material, such as solid foam or other insulating material. A top portion of the base 20 includes a lid 22 for covering the base and enclosing the components of the unit 10 therein. In addition, the lid 22 acts as a support surface for the heat exchange tube 30. Accordingly, the heat exchange unit comprises two external components, a base structure 20 for storing the hardware components of the unit 10 and a heat exchange tube 30 which is affixed to the lid 22 of the base and extends externally therefrom.

The inside perimeter and/or circumference of the base 20 includes a liner 24 adapted to receive the components of the unit 10. The liner 24 is placed adjacent to the inside perimeter of the base on both the vertical and bottom surfaces, and provides a protection surface for the internal components of the unit 10. The vertical walls of the base 20 include a plurality of air intake apertures 26, 28 for providing air passage and circulation to the inside of the base 20. The liner 24 includes reciprocating apertures 26*a*, 28*a* so as not to impede the entry of air into the inside of the base 20.

The compressor unit 40 is positioned on a bottom horizontal surface of the liner 24. The compressor 40 is connected to a pair of suction lines 44 for delivering a refrigerant to the compressor 40. Following compression, the refrigerant exits the compressor 40 and is delivered to the heat exchange tube via a coolant tube 46. In the case of an additional coil structure, a second coolant tube 46*a* is provided. After the compressed refrigerant has run through the vertical heat exchanger tube 30, it is delivered to an indoor coil evaporator, and subsequently recycled to the suction lines 44. Accordingly, the refrigerant is cycled through a closed system to allow cooling of warm air.

Adjacent to the compressor unit 40 is a blower 50. The blower 50 is mounted within the base. In a preferred embodiment, the blower 50 is mounted to an inside surface of the lid 22, and draws air from inside the housing and expels it vertically through the heat exchanger tube 30. The blower 50 provides two essential functions. First, the blower circulates air over the tubes of the heat exchange coil 100, if desired. Circulating air over the coil structure may enhance heat exchange. Second, the blower circulates air through the housing of the base 20.

As noted above, the housing unit includes a horizontal lid 22 for supporting the vertical heat exchange tube 30 mounted on an upper surface of the lid 22, and for enclosing the remaining components of the heat exchange unit 10. The lid 22 is secured to the housing by a mechanical component such as a hinge or a clip 42. When the internal components of the unit 10 require servicing, the lid 22 may be rotated about the mechanical component. A pair of tubes 60 extend from the housing to the bottom surface of the lid 22 and allows for the lid to be lifted off of the housing without disconnecting the coolant tubes 46. As the lid 22 is rotated about the hinges the length of the tubes 46 extend lengthwise. Accordingly, the mechanical components of both the interior portion of the housing and the lid allow the lid to be opened for servicing of the internal components of the unit 10 without disconnecting the lid from the housing 20.

Figure 2:
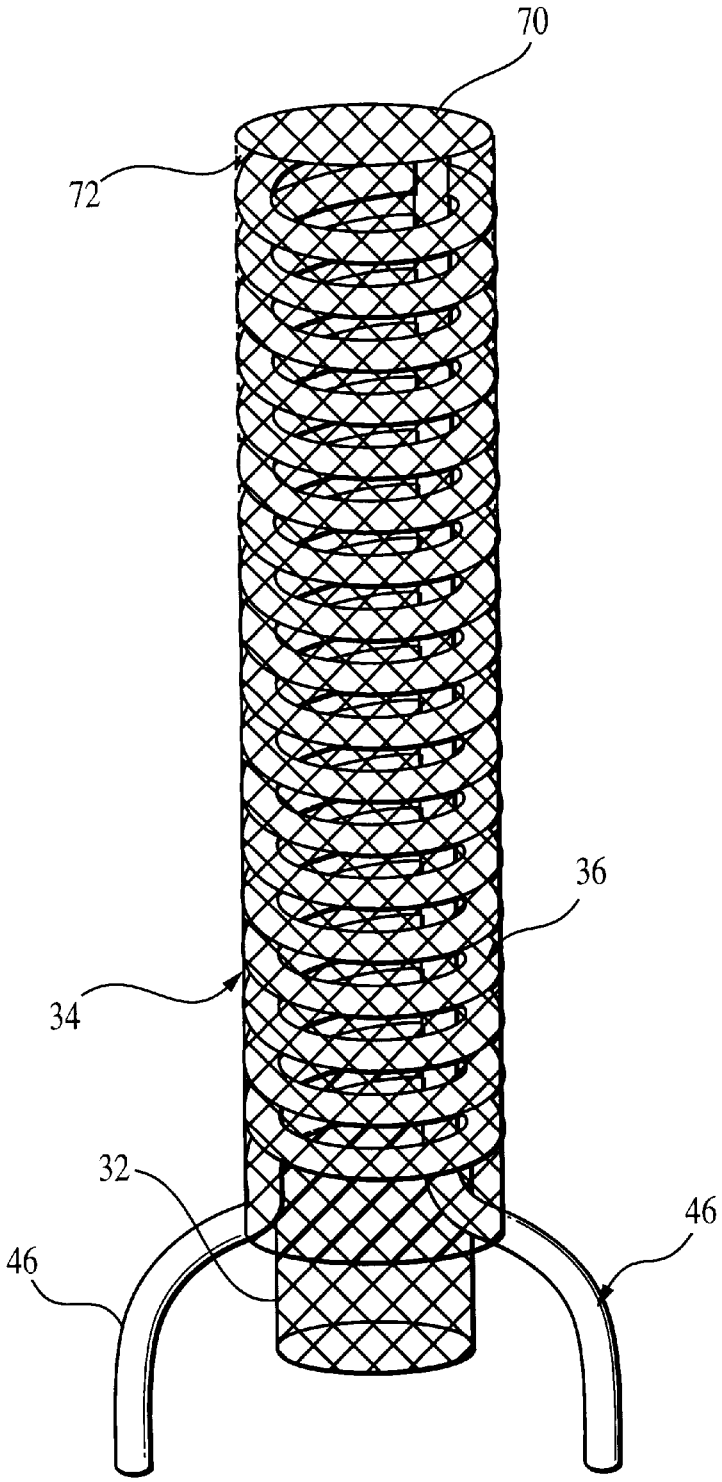
FIG. 2 is a sectional view of the vertical heat exchange tube.

FIG. 2 is a front view of the vertical heat exchange tube 30 of the preferred embodiment of the invention. The tube 30 is comprised of an inner tube 32, an outer tube 34 and a coil structure 36. The inner tube 32 is a liner preferably comprised of an aluminum perforated material. The outer tube 34 is also a liner preferably comprising of an aluminum perforated material. Both the inner tube 32 and the outer tube 34 may be made of a different material that allows the heat exchange to be conducted in an efficient manner. In a preferred embodiment, the inner tube 32 has a circumference of approximately seven inches, and the outer tube has a circumference of 7¾ inches. The difference between the circumference of the inner tube 32 and the outer tube 34 provides a spacing between the tubes, and allows a coil to be placed therein. The outside circumference of the inner tube 32 is wrapped with an Aluminum tube coil 38. The wrapping extends from an area near the top of the inner tube 32 to an area near the top of the base 20. A top portion of the heat exchange tube 30 includes a cover 70 for spreading air about the coil structure 38 in the channel 72 formed between the inner tube 32 and the outer tube 34. As the blower 50 forces air upwards into the heat exchange tube 30, the air enters the inner tube 32 and flows upward toward the cover 70. Upon reaching the cover 70, the air spreads out to the channel 72 formed between the tubes 32 and 34. The return air transfers heat between the inner tube 32 and the outer tube 34, and dissipates out through the apertures formed in the tubing material.

The size of the coil structure 36 is limited by the width of the channel 72 formed between the inner tube 32 and the outer tube 34. By wrapping the coil structure in a spiral configuration about the circumference of the inner tube, the need to weld any joints formed on the coils is mitigated. In a preferred embodiment, the heat exchange tube 30 ranges from about 24 inches to about 60 inches in height. The unit 10 ranges from a ½ ton unit which delivers approximately 6,000 BTU to a 3 ton unit which delivers 36,000 BTU for this given height. The output of the unit for the given height will depend upon the size of the coil and the size of the compressor. A 1½ ton unit will only require a coil structure with a ⅜ inch diameter, while a 3 ton unit will require multiple coil structures wrapped about the inner tube 32 and/or the outer tube 34, wherein the coil structure has a ⅜ inch diameter.

Figure 3:
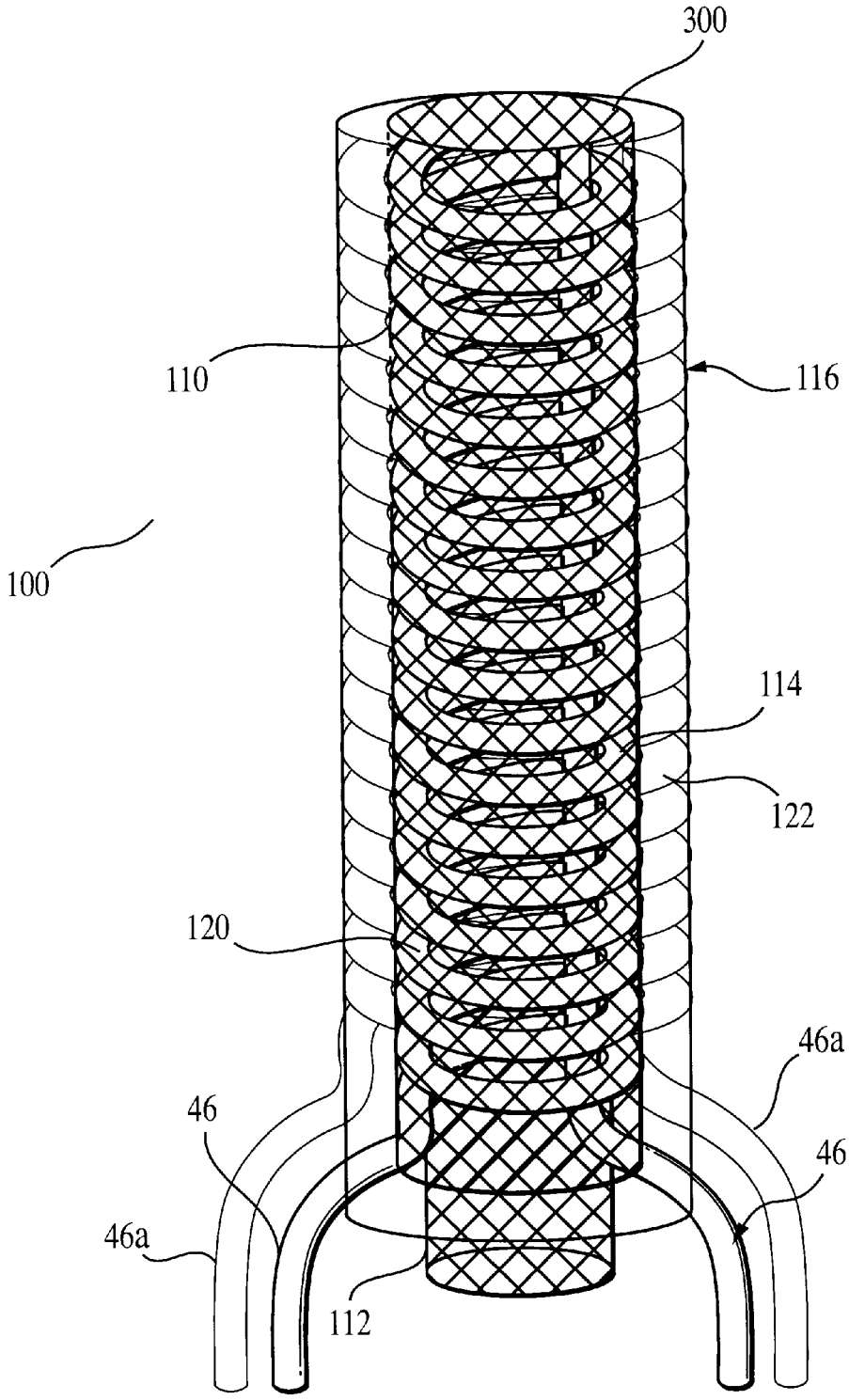
FIG. 3 is a sectional view of an alternative embodiment of the vertical heat exchange tube.

FIG. 3 is a front view of a further embodiment of this invention. The structure is similar to the unit 10 illustrated in FIG. 2, however this is a larger unit that can deliver a higher output. This unit 100 is a five ton heat exchange unit. This larger unit requires three tubes in the vertical tube exchange 110. The first tube 112 is an inner tube similar to tube 32. The outside surface of the tube is wrapped with a coil structure 120 in a spiral configuration. The coils extend from an area near the inner tube 112 to an area near the top of the tube 112 and adjacent to a cover 120. Adjacent to the outside surface of the coil structure 120 of the inner tube 112 is an intermediate tube 114. This tube is placed between the inner tube 112 and an outer tube 116. The intermediate tube 114 also has a coil structure 122 wrapped in a spiral configuration about the outside surface thereof. Adjacent to the outside surface of the coil structure 122 of the intermediate tube 114 is the outer tube 116. Each of the tubes 112, 114 and 116 are similarly designed. The liner tubes 112, 114 and 116 are each preferably comprised of a perforated metallic material that allows air to dissipated through the apertures. In a preferred embodiment the liner tubes 112, 114 and 116 are comprised of a metallic material, such as Aluminum. However, instead of Aluminum, the liner tubes may be made from another metallic material having suitable or similar quality. During operation, air from the blower is forced upward into the tube structure through the inside of the inner tube 112. The air flows upward through the inner tube until it reaches the top cover 120, which functions to spread the air about the coil structures 120 and 140 of both the inner tube 112 and the intermediate tube 1 14. Accordingly, the two sets of coil structures together with the additional vertical tube of the unit provide for a greater capacity.

Increasing capacity and efficiency of the unit of the preferred embodiment is not limited to increasing the quantity of vertical tubes. Rather, the unit may also be designed with a greater height. For example, a unit with a vertical heat exchange tube in excess of twenty four inches would reduce the liquid line and would increase efficiency. Such a unit would effectively have a greater length of coils wrapped about the inner tube 32, 112, and possibly an intermediate tube 114. However, when increasing either the height of the unit or the length of the coil structure, the increased capacity of the unit remains limited by the size of the compressor stored in the housing. Accordingly, the unit may include a height in excess of twenty four inches, or it may include a plurality of concentric elongated tubes with coils wrapped about the circumference of an inner tube, or combinations thereof.

In addition, a single unit may be appropriate for a residential housing unit, and a larger single unit may be appropriate for a larger residential housing unit. Multiple units of the unit disclosed in the preferred embodiment may be serially connected to cool a larger structure. Accordingly, the unit of the preferred embodiment may be employed to cool residential or commercial structures.

Different size units will require different size compressors for producing the output desired. It is known that the compressor and coolant pump can generate noise which may become unpleasant. The unit of the preferred embodiment is designed such that the base can be placed above a ground surface or buried into the ground to reduce its visible size and/or to reduce the noise associated with the compressor and coolant pump. Accordingly, the base may be placed underground with the heat exchange tube placed above the ground surface to reduce noise associated with operation of the unit.

Figure 4:
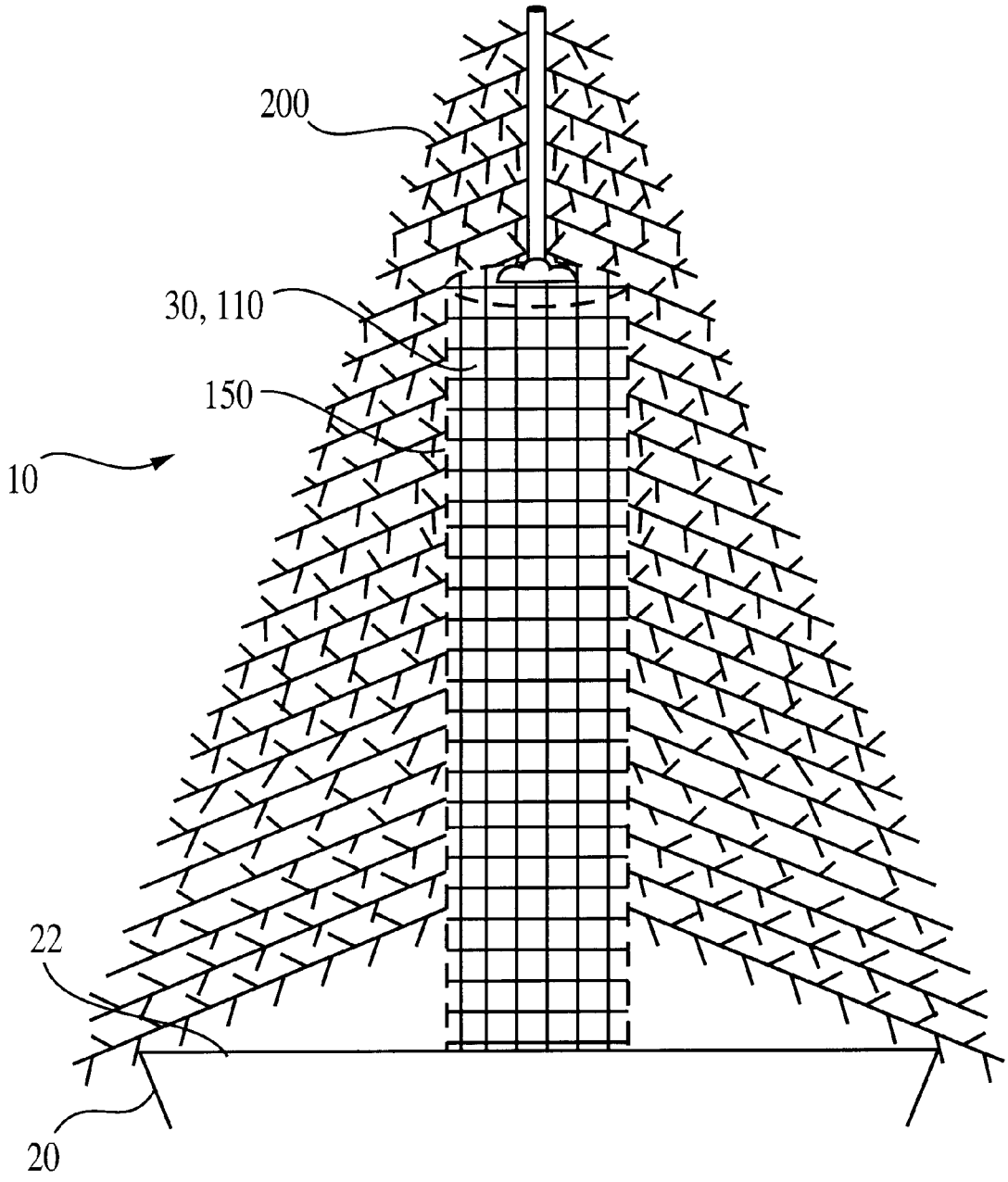
FIG. 4 is a sectional view of the vertical heat exchange tube with a camouflage application.

An aesthetic property of the unit, allows the heat exchange tube 30, 110 to be camouflaged, so that the unit may not be noticeable to passers by. FIG. 4 is an illustration of one form of camouflaging the heat exchange tube and unit. The heat exchange tube extends vertically from the upper surface of the lid 22 and is adapted to be covered by an artificial or natural shrubbery 200 which is placed around the tube 30, 110. The shrubbery includes an inner cylindrical lining 150 with a diameter greater than the diameter of the outer tube 34, 116. Portions of the shrubbery are secured to the lining, and may be designed to look like branches of a tree. Since thick branches, leaves, and/or needles may impede air flow within the heat exchange tube, the inner portions of the branches can be thinned to remove potential airflow obstructions. Furthermore, the base 20 may be placed in a large flower pot. Accordingly, when the flower pot is combined with the shrubbery, the unit 10, 100 looks like a potted plant and not like a heat exchange unit.

Alternative Embodiments

It will be appreciated that, although specific embodiments of the invention have been described herein for purposes of illustration, various modifications may be made without departing from the spirit and scope of the invention. In particular, the coil structure may be comprised of multiple tubes of different sizes. For example, a ⅛ inch diameter coil may be employed, or multiple ⅛ inch diameter coils may be wrapped about the inner tube 32, 112 and possibly the intermediate tube 114. Three ⅛ inch coils may be wrapped about the inner tube 32, 112. Multiple coils provide an increased surface area for reaction, and thereby allows the refrigerant to get cooler quicker. In addition to modifying the unit to accommodate wrapping multiple coil structures about the outside circumference of the tube 32, 112, 114, the unit may also include aluminum flakes applied to the outside surface of the coils. The flakes are affixed to the surface of the coils with a thermally conductive material, and function to help dissipate heat from the surface of the coils. Accordingly, by varying the size of the coils and the quantity of coils wrapped about the inner tube 32, 112 and intermediate tube 114, the cooling efficiency of the unit may be modified.

In addition to varying the size and quantity of the coil structure, the layout and placement of the coil structure about the inner tube 32, 112 and intermediate tube 114 may be modified. The preferred embodiment discloses wrapping the coils in a spiral configuration about the exterior surface of the inner tube 32, 112 and intermediate tube 114. The spiral configuration alleviates the need to solder joints between breaks of the coil structure. However, the coil structure may be laid upon the inner tube 32, 112 and intermediate tube 114 in varying configurations that provide the necessary surface area to provide the desired efficiency and output of the unit. Accordingly, the scope of protection of this invention is limited only by the following claims and their equivalents.

We claim:

1. A heat exchanger comprising:

a housing unit;

a compressor mounted within said housing unit for compressing a refrigerant;

a blower mounted within said housing unit for circulating air over a coil structure and for circulating air through said housing;

a tube for delivering said compressed refrigerant to a heat exchange tube;

said heat exchange tube is longitudinal and mounted vertically to an exterior surface of a base of said housing and said tube has a plurality of concentric liners with said coil structure wrapped about an exterior surface of an interior liner, wherein said coil structure dissipates heat.

2. The heat exchanger of claim 1, further comprising an exterior liner for enclosing the interior liner and said coil structure.

3. The heat exchanger of claim 2, wherein said interior liner and said exterior liner are comprised of a perforated Aluminum material.

4. The heat exchanger of claim 2, further comprising an intermediate liner mounted between said interior liner and said exterior liner.

5. The heat exchanger of claim 4, wherein said interior, intermediate and exterior liners are concentric.

6. The heat exchanger of claim 4, wherein said intermediate liner comprises a coil structure wrapped about an exterior surface of said liner.

7. The heat exchanger of claim 6, wherein said coil comprises a spiral configuration.

8. The heat exchanger of claim 6, wherein said interior liner comprises a plurality of ⅛ inch coils wrapped about the exterior perimeter for providing increased surface area of said coils.

9. The heat exchanger of claim 8, wherein said intermediate liner comprises a plurality of ⅛ inch coils wrapped about the exterior perimeter for providing increased surface area of said coils.

10. The heat exchanger of claim 1, further comprising a baffle to enclose a top portion of said liner and to direct air towards said housing.

11. The heat exchanger of claim 1, further comprising an artificial plant extending from said housing unit and enclosing said heat exchange tube.

12. The heat exchanger of claim 1, wherein said coil diameter ranges from about ⅛ inches to about ⅜ inches in diameter.

13. A method of cooling an enclosed structure comprising the following:

providing a housing unit for storing a compressor and a blower;

mounting a vertical heat exchange tube structure on a top exterior surface of said housing, said vertical tube comprising an interior liner extending from said top surface of said housing to a top area of said tube with a coil structure spirally wrapped about an exterior surface of said interior liner;

circulating air from said blower to said coil through said housing; and delivering a compressed refrigerant from said compressor to said tube.

14. The method of claim 13, further comprising enclosing said interior liner with a concentric exterior liner.

15. The method of claim 14, further comprising providing an intermediate liner, concentric with said interior and exterior liners, with a coil structure wrapped about an exterior surface of said interior and intermediate liners.

16. The method of claim 13, wherein said liners are comprised of a perforated Aluminum material for allowing air to dissipate from said coils.

17. The method of claim 13, further comprising enclosing said top of said vertical tube with a baffle for forcing air moving in an upward direction to travel in an outward and downward direction exterior to said liner.

18. The method of claim 13, further comprising affixing flakes to an exterior surface of said coil.

19. The method of claim 13, further comprising camouflaging said vertical tube structure by placing an artificial plant over said vertical tube.

20. The method of claim 13, further comprising serially connecting a plurality of said units to provide cooling for a large enclosed structure.

* * * * *